United States Patent [19]

Kitanaka

[11] Patent Number: 4,616,720

[45] Date of Patent: Oct. 14, 1986

[54] DIVIDED-BUCKET TYPE ROTARY EXCAVATOR

[76] Inventor: Katsumi Kitanaka, 24-8, Sakuragaoka-Cho, Shibuya-Ku, Tokyo, Japan

[21] Appl. No.: 653,841

[22] Filed: Sep. 24, 1984

[30] Foreign Application Priority Data

May 15, 1984 [JP] Japan ..... 59-95751

[51] Int. Cl.[4] ..... E21B 11/00; E21B 7/28

[52] U.S. Cl. ..... 175/267; 175/263; 175/285

[58] Field of Search ..... 175/263, 264, 265, 267, 175/271, 285, 292

[56] References Cited

U.S. PATENT DOCUMENTS

| | | | |
|---|---|---|---|
| 2,910,274 | 10/1959 | Scott | 175/267 X |
| 3,038,710 | 6/1962 | Robbins | 175/263 X |
| 3,336,989 | 8/1967 | Henderson | 175/285 X |

FOREIGN PATENT DOCUMENTS

| | | | |
|---|---|---|---|
| 119290 | 4/1983 | Japan . | |
| 844296 | 8/1960 | United Kingdom | 175/263 |

*Primary Examiner*—Stuart S. Levy
*Assistant Examiner*—David Werner
*Attorney, Agent, or Firm*—Stevens, Davis, Miller & Mosher

[57] ABSTRACT

A divided bucket type rotary excavator comprises cutter units constructed by dividing a bottomed cylindrical bucket into plural portions, whose curved sidewalls and bottom plates are provided with bits on their leading edges. The cutter units are arranged about a center shaft radially movably toward and away from the center shaft.

The center shaft consists of an outer hollow cylinder having a polygonal cross-section and an inner hollow cylinder slidably fitted in the outer hollow cylinder. There is further provided a hydraulic cylinder arranged in the inner and outer hollow cylinders to move the center shaft telescopically, a set of parallel links connecting the outer hollow cylinder to each the cutter unit, and a link having a length one half of that of the parallel links for connecting a middle point of each lower link of the parallel links to a lower end of the inner hollow cylinder, thereby moving the cutter units radially toward and away from the center shaft by telescopically moving the outer and inner hollow cylinders relatively to each other by means of the hydraulic cylinder.

8 Claims, 11 Drawing Figures

DIVIDED-BUCKET TYPE ROTARY EXCAVATOR

BACKGROUND OF THE INVENTION

1. Field of the Invention

This invention relates to a bucket type rotary excavator for use in foundation work (for cast-in-place piles) or the like for civil engineering and construction works.

2. Description of the Prior Art

In case of execution of a cast-in-place pile in the ground a, it is advantageous to expand the lower end of a column body b of the pile as shown in FIG. 1, because the expanded end increases its bearing power.

The reverse circulation method for mechanical excavation has been used for the execution of such a pile having an expanded lower end. In excavating the ground a by rotary bits (not shown) according to the reverse circulation method, a stand pipe d is driven in the proximity of the surface of the ground and a slurry of bentonite or slime water is filled in the pile hole to prevent inner walls f of the hole from falling down as shown in FIG. 2. On the other hand, the rotary bits are rotated and forced downward to excavate the ground. The excavated earth and sand are exhausted out of the pile hole with the aid of the reverse circulation of the slurry or water.

In this reverse circulation method, however, the expanded bottom g of the pile hole is unavoidably inverted conical as shown at h in FIGS. 1 and 2, so that it contains precipitated slime i at its bottom. After placing of concrete in the pile hole to form a foundation pile, the stayed slime tends to reduce the bearing power of the foundation pile at the bottom to decrease its reliability.

In order to solve these problem, the applicant had proposed a divided bucket type rotary excavator comprising cutter units constructed by dividing a bottomed cylindrical bucket into plural portions which are arranged about a rotatable shaft and adapted to move radially toward and away from the rotatable shaft (Japanese Patent Application Publication No. 21,079/83 patented as Japanese Pat. No. 1,190,290). The invention of the present application relates to an improvement of the excavator of the Japanese Patent.

SUMMARY OF THE INVENTION

It is a primary object of the invention to provide an improved divided-bucket type rotary excavator which eliminates all the disadvantages of the prior art.

It is therefore another object of the invention to provide a divided-bucket type rotary excavator which is capable of expanding a bottom of the pile hole with ease and is also capable of executing dry excavation, a bottom surface of the expanded pile hole being flat to prevent any slime from staying thereat.

In order to achieve these objects, the divided bucket type rotary excavator according to the invention comprises cutter units constructed by dividing a bottomed cylindrical bucket into plural portions, whose curved sidewalls and bottom plates are provided with bits on their leading edges, said cutter units being arranged about a center shaft radially movably toward and away from said center shaft.

In a preferred embodiment of the invention, the center shaft consists of an outer hollow cylinder having a polygonal cross-section and an inner hollow cylinder slidably fitted in said outer hollow cylinder, and the excavator further comprises a hydraulic cylinder arranged in the inner and outer hollow cylinders to move the center shaft telescopically, a set of parallel links connecting the outer hollow cylinder to each the cutter unit, and a link having a length one half of that of the parallel links for connecting a middle point of each lower link of the parallel links to a lower end of the inner hollow cylinder, thereby moving the cutter units radially toward and away from the center shaft by telescopically moving the outer and inner hollow cylinders relatively to each other by means of the hydraulic cylinder.

In order that the invention may be more clearly understood, preferred embodiments will be described, by way of example, with reference to the accompanying drawings.

DETAILED DESCRIPTION OF THE PREFERRED EMBODIMENT

Figure 3:
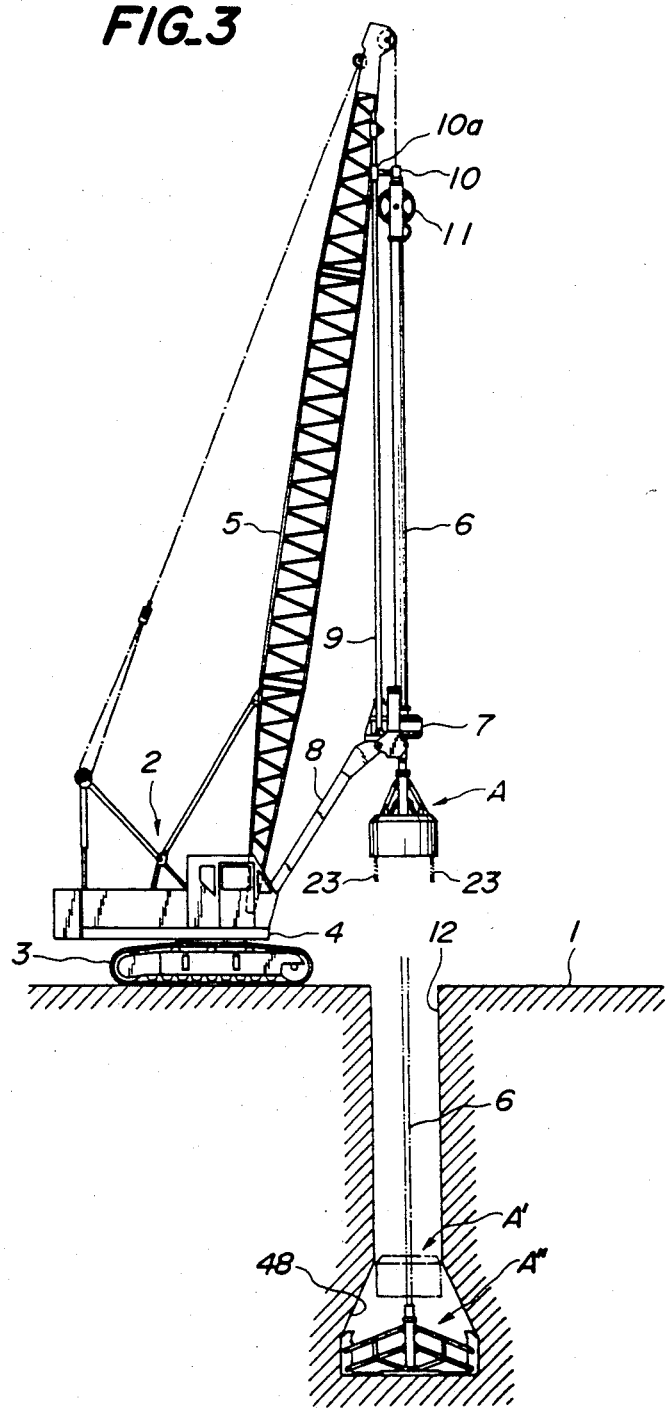
FIG. 3 is an elevation illustrating excavation effected by a crawler crane equipped with the rotary excavator according to the invention.

FIGS. 3–10 illustrate one embodiment of the invention. Referring particularly to FIG. 3, a crawler crane 2 equipped with a rotary excavator according to the invention includes a crawler 3 supporting the crawler crane 2 on a foundation or ground 1, a swivel base 4 swiveling on the crawler 3, a crane boom 5 mounted on the swivel base 4 so as to do lifting motion, a kelly-bar 6 hanging from a free end of the boom in ascendable and descendable manner, a driving device 7 for (hydraulically) rotatatively driving the kelly-bar 6, a connecting arm 8 for connecting the driving device 7 and the swivel base 4, a swivel guide rod 9 arranged in parallel with the kelly-bar 6 between the upper end of the crane boom 5 and the driving device 7, and a hydraulic swivel joint 10 arranged on an upper end of the kelly-bar 6 rotatably relatively thereto and slidably relatively to the swivel guide rod 9 through a guide member 10*a*. The kelly-bar 6 has a hydraulic hose reel 11 about which is wound a hydraulic hose (not shown) having one end connected to a hydraulic pressure supply source (not shown) provided on the swivel base 4 and the other end connected through the swivel joint 10 to a hydraulic cylinder (to be later described) in a divided bucket type rotary excavator according to the invention connected to a lower end of the kelly-bar 6.

The kelly-bar 6 shown in FIG. 3 is adapted to be equipped at its lower end with a drilling bucket (not shown) for an earth drill. A reference numeral 12 denotes a pile hole by excavating the ground 1 with the earth drill.

The divided bucket type rotary excavator according to the invention will be explained by referring to FIGS. 4–10. A connecting bracket 13 having a flange **13*b* is adapted to be detachably connected to the lower end of the kelly-bar by a pin (not shown) passing through the lower end of the kelly-bar 6 and apertures 13*a* of the connecting bracket 13. An outer cylinder 14 having a square or rectangular cross-section is connected through its flange 14*a* and the flange 13*b* to the connecting bracket 13 by means of bolts and nuts (not shown). An inner cylinder 15 having a square or rectangular cross-section slidably fitted in the outer cylinder 14 to form a center shaft B. In the outer and inner cylinders 14 and 15 is inserted a hydraulic cylinder 16 whose upper end is connected to a bracket 13*c* extending downward from the lower end of the connecting bracket 13 by means of a connecting pin 17. A lower end of a piston rod 16*a* of the hydraulic cylinder 16 is connected by a pin 19 to a crosshead provided at a lower end of the inner cylinder 15**.

Figure 5:
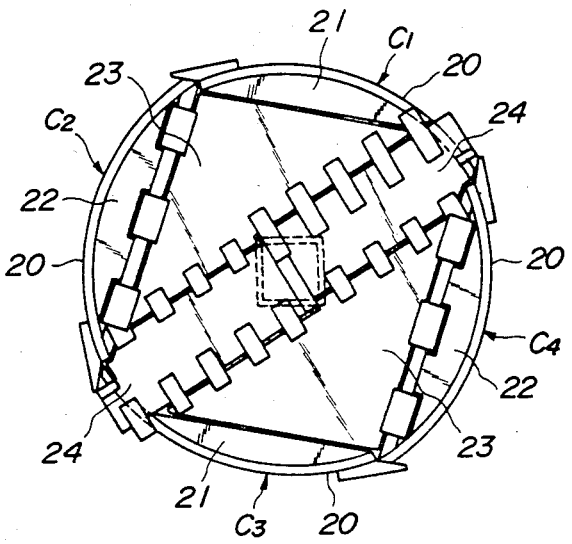
FIG. 5 is a bottom plan view of the excavator shown in FIG. 4.

As shown in FIG. 5, four cutter units $C_1$, $C_2$, $C_3$ and $C_4$ are formed by a combination of curved sidewall plates 20 obtained by dividing a hollow cylindrical body into four parts and bottom plates 21, 22, 23 and 24 formed in such shapes so as to form a bottom plate of the above which will follow the cylindrical body when its diameter is at a minimum.

Figure 7:
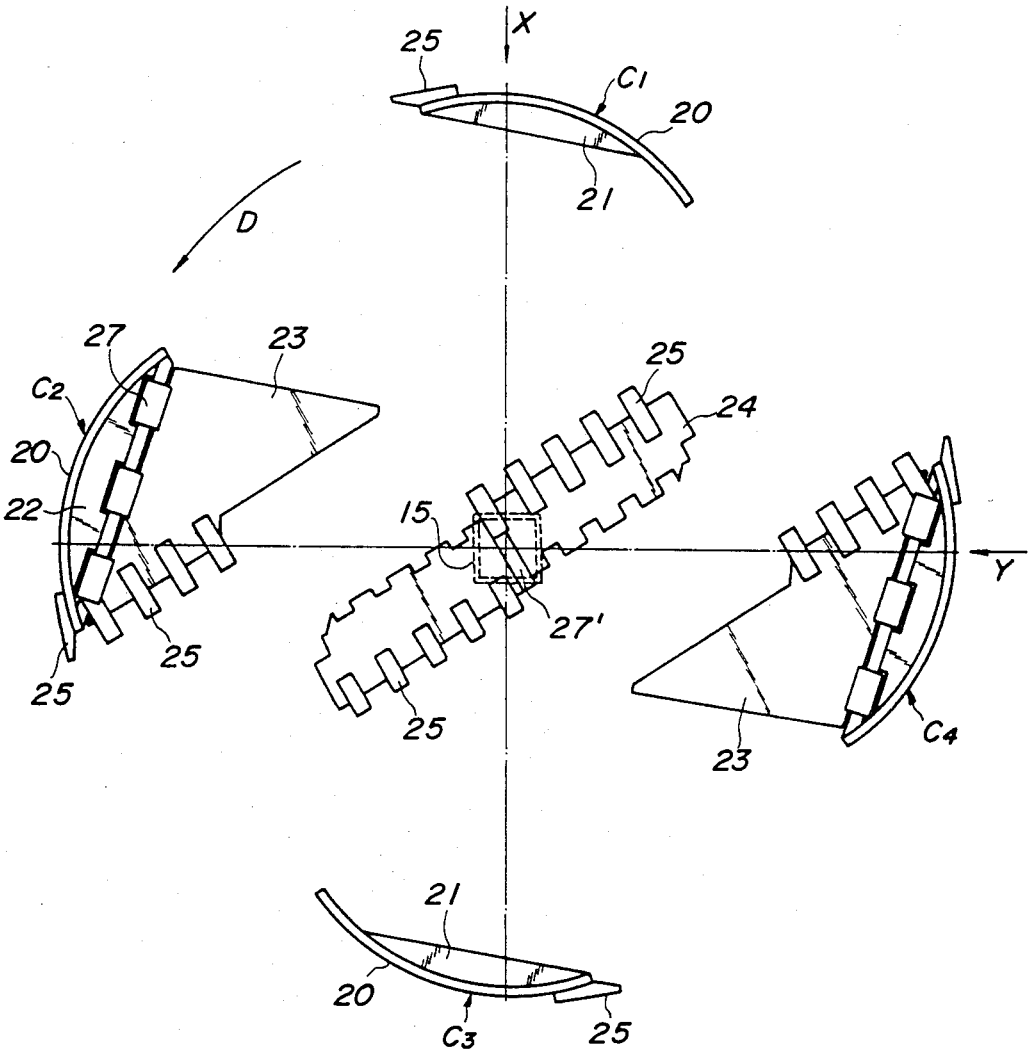
FIG. 7 is a bottom plan view of the excavator shown in FIG. 6 for illustrating the arrangement of components of the bucket.
Figure 8:
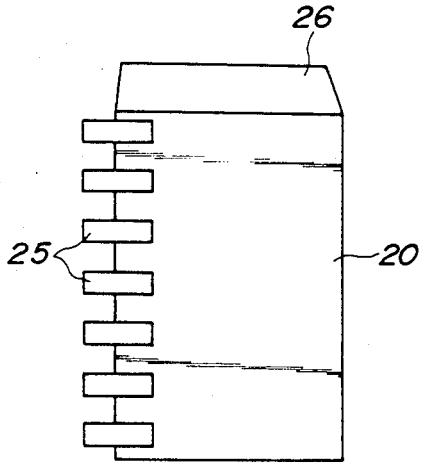
FIG. 8 is a front elevation of a curved sidewall plate of each the cutter unit as viewed in a direction shown by an arrow X or Y in FIG. 7.

In more detail, as shown in FIG. 7, each of the diametrically opposed cutter units $C_1$ and $C_3$ comprises the curved sidewall plate 20 and the bottom plate 21 in the form of a crescent secured to the sidewall plate. A plurality of bits 25 are arranged on a front edge of the curved sidewall plate 20 which is a leading edge of the plate in a rotating direction thereof. To an upper edge of each the curved sidewall plate 20 is integrally fixed a guide edge 26 which is inwardly inclined (FIG. 8).

Each of the other diametrically opposed cutter units $C_2$ and $C_4$ comprises the curved sidewall plate 20 and the bottom plate 22 in the form of a crescent to which is connected a triangular bottom plate 23 by means of hinges 27. A plurality of bits 25 are arranged on a front edge of the triangular bottom plate which is a leading edge of the plate in the rotating direction thereof. Moreover, a plurality of bits 25 are arranged on a front edge of each the curved sidewall plate 20 whose upper edge has a guide edge 26 integrally fixed thereto.

An elongated rectangular bottom plate 24 is fixed with its center to a lower end of the inner cylinder 15 and is provided with a plurality of bits 25 at leading edges thereof on both sides of the center. A reference numeral 27' denotes ribs provided on the center of the bottom plate 24.

Two brackets 28 and two brackets 29 spaced downward a predetermined distance therefrom are provided on each the sidewall of the outer cylinder 14. Two brackets 30 and 31 are provided one a predetermined distance above the other on an inside of each the curved sidewall plate 20 of the cutter units $C_1$–$C_4$. Brackets 32 are provided on the sidewalls of the inner cylinder 15 at its lower end.

Figure 4:
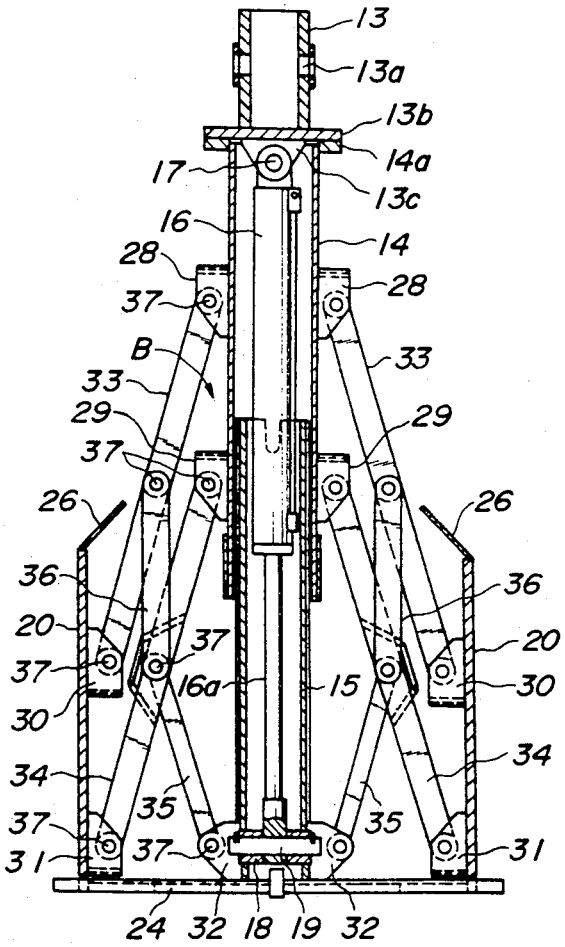
FIG. 4 is a sectional front view of the excavator retracted to the minimum diameter position according to the invention.
Figure 6:
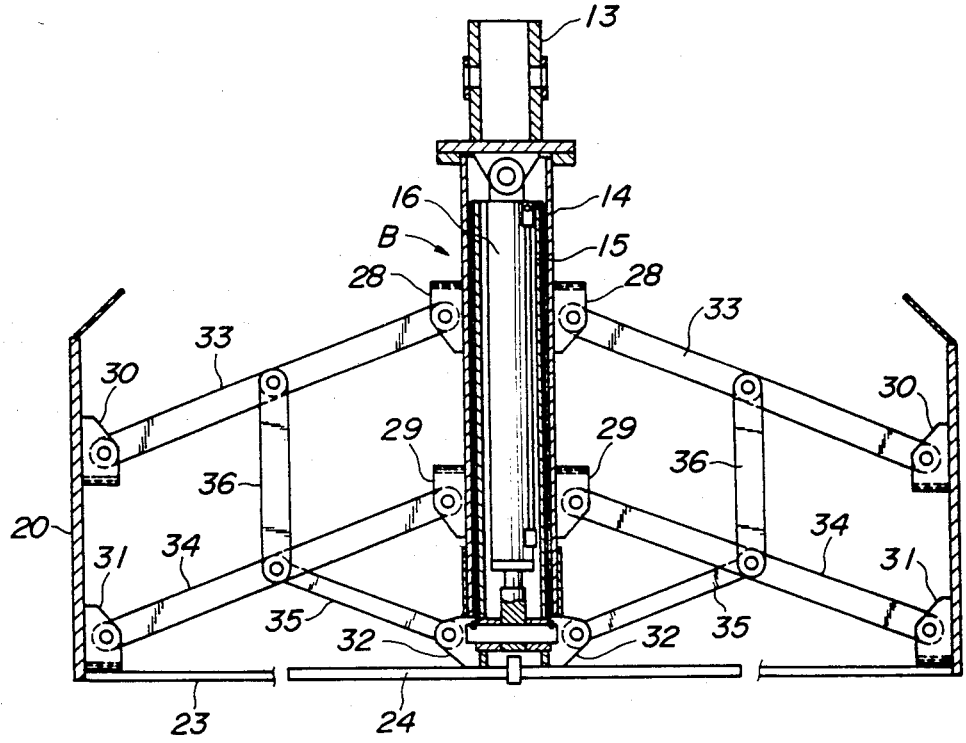
FIG. 6 is a sectional front view of the excavator extended to the maximum diameter position according to the invention.

The cutter units $C_1$–$C_4$ are arranged about the center shaft B. The brackets 28 and 30 are connected to each other by links 33 and the brackets 29 and 31 are connected to each other by links 34 having the same length as that of the links 33 to form a parallel link mechanism (FIG. 4 or 6).

A middle point of each the link 34 and each the bracket 32 are connected by a link 35 having a length one half of that of the link 34 to form a Scott-Russel parallel motion mechanism.

Moreover, the links 33 and 34 are connected at their middle points by links 36 having a length equal to the predetermined distance between the links 33 and 34. The links 36 can, however, be dispensed with. A reference numeral 37 denotes pins for connecting the links.

Figure 9:
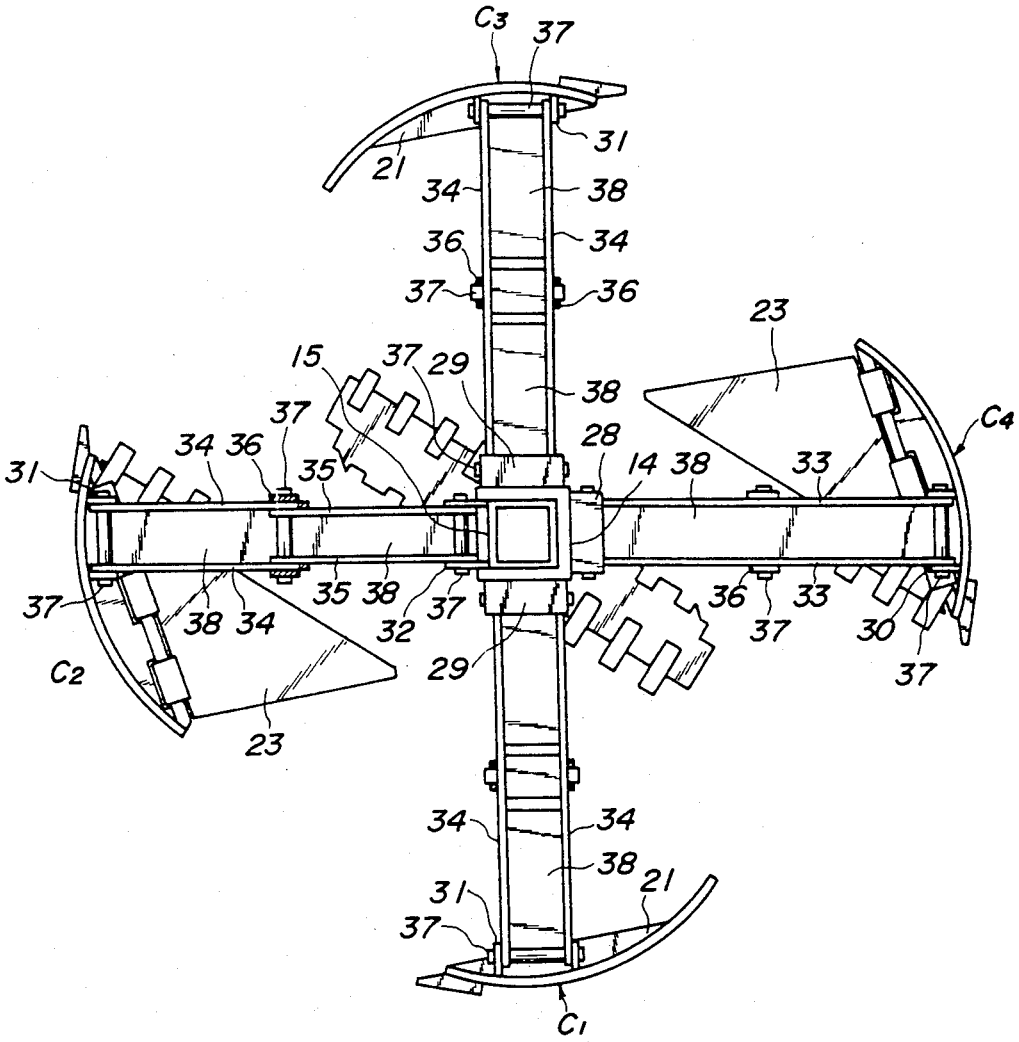
FIG. 9 is a plan view illustrating respective link mechanisms shown in FIG. 6.

Referring to FIG. 9 illustrating the respective links in a plan view, a distance between the links 33 or between the links 34 is preferably as wide as possible and reinforcing plates 38 are preferably provided therebetween in order to reinforce the links 33 and 34.

FIGS. **10*a* and 10*b* illustrate one example of a mechanism for closing and opening the bottom plate 23 of each the cutter unit $C_2$ or $C_4$. An upper support 39 and an intermediate support 40 therebelow are provided on the inside of each the curved sidewall plate 20. A closing and opening rod 41 passes through the upper and intermediate supports 39 and 40 and is provided at its lower end with a ratch member 42 fixed thereto. The ratch member 42 is rectangular in a plan view and is formed at its lowermost end with an edge 42*a* oblique at 30° to a longitudinal line of the rectangle of the ratch member 42 and with inclined surfaces 42*b* and 42*c* starting from the edge 42 and extending obliquely upward on both sides of the edge 42. An upper end of the rod 41 is bent into a crank to form a handle 43 to which is secured a spring 44 so as to keep the ratch member 42 in position for holding the bottom plate 23** in its closed position.

Moreover, the bottom plate 23 is formed with an aperture **23*a* and provided with a hollow cylinder 45 fixed to the bottom plate 23 so as to surround the aperture 23*a*. A cover plate 46 is fixed to an upper end of the hollow cylinder 45 and is formed with a rectangular aperture 47 whose longitudinal center line L is coincident with the line of the edge 42*a* oblique at 30° to the longitudinal center line of the ratch member 42 so as to permit the ratch member to pass through the rectangular aperture 47, if the ratch member is turned through 30° about the axis of the rod 41**.

The operation of the excavator constructed as above described according to the invention will be explained hereinafter.

Figure 1:
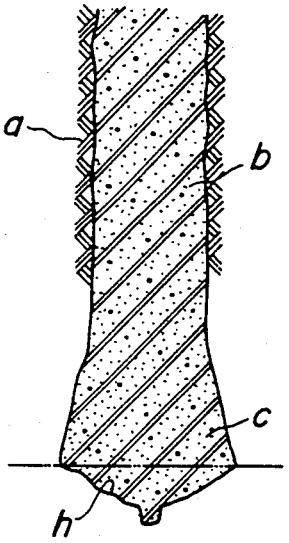
FIG. 1 PRIOR ART
FIG. 1 is a vertical sectional view of a pile having an expanded lower end formed according to the prior art.
Figure 2:
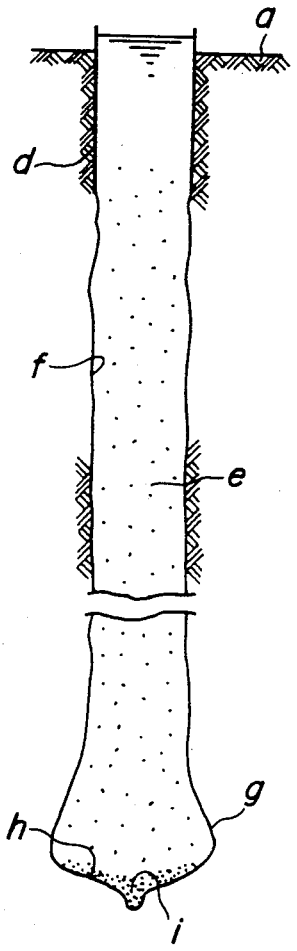
FIG. 2 PRIOR ART
FIG. 2 is a vertical sectional view for the reverse circulation method of the prior art.

After a pile hole 12 has been formed in a foundation or ground 1 by means of an earth drill or the like, the divided bucket type rotary excavator A according to the invention is connected to and hung from the lower end of the kelly-bar 6 as shown in FIG. 3 and the hydraulic cylinder 16 is extended as shown in FIG. 4. When the hydraulic cylinder 16 has been extended to its fully extended position, the cutter units $C_1$–$C_4$ will have been moved inwardly in parallel with each other with the aid of the parallel links 33 and 34 and the Scott-Russel parallel motion links 34 and 35 as shown in FIGS. 4 and 5 to bring the diameter of the bucket formed by the cutter units $C_1$–$C_4$ to a minimum value. A reference A in FIG. 1 illustrates the excavator in such a minimum diameter position in which its bottom plates may be maintained in their closed position.

The diameter of such a completely closed bucket is slightly smaller than that of the formed pile hole 12, so that the excavator A can be lowered together with the kelly-bar 6 into the pile hole 12 by operating the crawler crane 2.

The bucket is once stopped in a position A' where the operation for expanding the pile hole 12 is started. In this position A', the rotary excavator according to the invention is rotated through the kelly-bar 6 by means of the driving device 7 and the hydraulic cylinder 16 is retracted, while the rotary excavator is lowered by the operation of the crane. In this manner, the cutter units $C_1$–$C_4$ are progressively moved downward and outward away from each other, so that the pile hole 12 is expanded until the rotary excavator assumes its fully expanded position as shown at A" in FIG. 3.

In more detail, when the hydraulic cylinder 16 is changed from its extended position as shown in FIG. 4 to the retracted position in FIG. 6, the outer cylinder 14 moves over relatively to the inner cylinder 15 to shorten the overall length of the center shaft B, so that the respective cutter units $C_1$–$C_4$ move outerwardly in parallel with each other with the aid of the function in conjunction with the parallel links 33 and 34 and the Scott-Russel parallel motion links 34 and 35, until the cutter units $C_1$–$C_4$ assume the fully expanded position as shown in FIGS. 4 and 5.

During such a movement, the cutter units $C_1$–$C_4$ are rotated in a direction shown by an arrow D in FIG. 7, so that the bits 25 arranged on the leading edges of the cutter units $C_1$–$C_4$ and the bottom plate 24 fixed to the inner cylinder 15 excavate the earth and sand to expand the pile hole. As the result, a snug conical expanded hole 48 is formed at the bottom of the pile hole 12 in the ground.

After the completion of the excavation for expanding the pile hole 12, the hydraulic cylinder 16 is extended. When the hydraulic cylinder 16 is extended from the position shown in FIG. 6 to that shown in FIG. 4, the cutter units $C_1$–$C_4$ are moved in parallel with and toward each other into the completely closed position as shown in FIGS. 4 and 5, so that the excavated earth and sand are accommodated in the closed bucket. The rotary excavator A is then lifted above the ground through the pile hole 12 by the operation of the crane. Thereafter, the swivel base 4 of the crawler crane 2 is rotated to bring the excavator A immediately above a load carrying platform of a dump truck (not shown) and then the bottom plates 23 of the cutting units are opened to exhaust the earth and sand onto the load carrying platform of the dump truck.

Figure 10A:
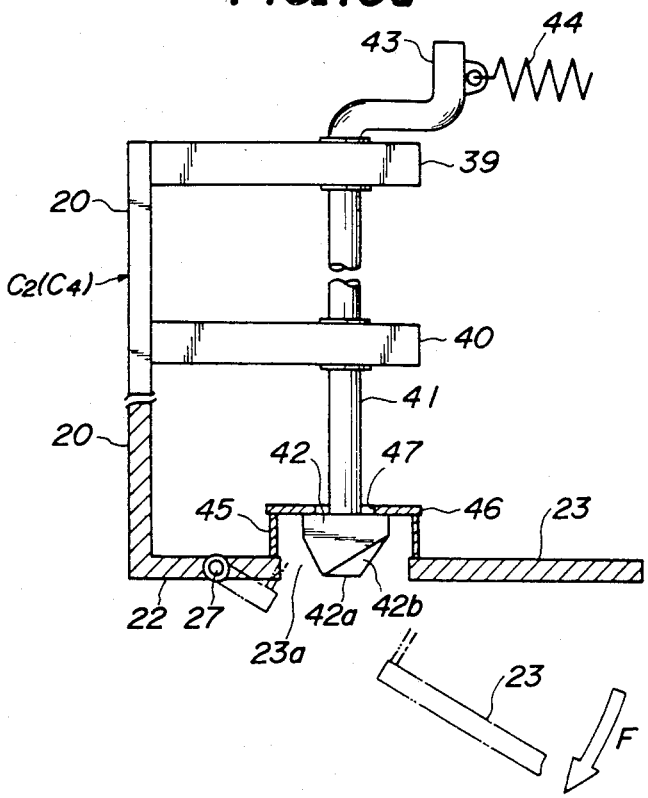
FIG. 10*a* is a partial sectional view of a mechanism for closing and opening a bottom plate of the cutter unit.
Figure 10B:
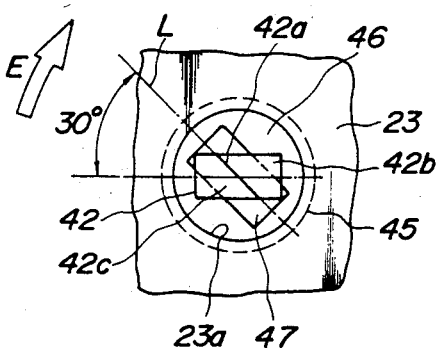
FIG. 10*b* is a partial bottom plan view of the mechanism shown in FIG. 10*a*.

In order to open the bottom plates 23, the handle 43 shown in FIG. 10*a* is rotated against a force of the spring 44 in a direction shown by an arrow E in FIG. 10*b* so as to bring the ratch member 42 into alignment with the rectangular aperture 47 to release the bottom plate 23, with the result that the bottom plate 23 is pivotally moved by its self weight and the weight of the earth and sand thereon in a direction by an arrow F in FIG. 10*a*.

In order to close the bottom plate 23, it may be forced into its closed position by an external force or the bucket is set on a flat ground to bring the bottom plate into the closed position. When the bottom plate 23 is raised, edges of the rectangular aperture 47 is brought into contact with the inclined surfaces 42*b* of the ratch member 42. Further upward movement of the bottom plate 23 causes the ratch member 42 to rotate against the force of the spring 44 by a cam action of the inclined surfaces 42*b* until the ratch member 42 is aligned with the rectangular aperture 47. At this moment, the ratch member 42 passes through the rectangular aperture 47 of the bottom plate 23 which thus arrives at the closed position. When the ratch member 42 has passed through the rectangular aperture 47, the ratch member 42 is forced to rotate 30° relatively to the rectangular aperture 47 by the action of the spring 44 as shown in FIG. 10*b*.

One cycle of the excavation with the excavator according to the invention for expanding the bottom of the pile hole is completed in the manner as above described. In fact, the above cycle may be repeated any number of times if required.

As can be seen from the above description, the rotary excavator according to the invention can carry out the operation for expanding a bottom of a pile hole with ease without any trouble. As the formed bottom of the expanded pile hole is flat, any slime does not stay at the bottom, so that the reliability of bearing power of a pile is improved.

With the excavator according to the invention, moreover, the excavation can be effected irrespective of whether water exists or not in the ground and does not require a circulation liquid of bentonite or the like as in the prior reverse circulation method, so that there is no risk of public nuisance resulting from the excavated earth and sand containing such a circulation liquid. Therefore, the cost for preventing the public nuisance can be reduced and the time required for the construction work can be shortened because of the bucket excavation, so that the present invention is advantageous in the economical aspect.

Particularly, the excavator according to the invention comprises the cutter units supported on the center shaft by means of the parallel links and the Scott-Russel parallel motion links to ensure the large parallel motions of the cutter units, thereby forming holes having expanded lower ends whose diameters are about twice those of pile holes with ease. The employed mechanism includes a reduced number of links to simplify the construction of the excavator which is easy and inexpensive to manufacture.

It is further understood by those skilled in the art that the foregoing description is that of preferred embodiments of the disclosed apparatuses and that various changes and modifications may be made in the invention without departing from the spirit and scope thereof.

What is claimed is:

1. A divided bucket type rotary excavator comprising a plurality of cutter units having generally flat bottom plates and curved sidewalls with bits on their leading edges, said cutter units being arranged about a center shaft and mounted to be radially movably toward and away from said center shaft, said center shaft consisting of an outer hollow cylinder having a polygonal cross-section and an inner hollow cylinder slidably fitted in said outer hollow cylinder, and the excavator further comprising a fluid operated cylinder arranged in said inner and outer hollow cylinders to move said center shaft telescopically, a set of parallel links connecting said outer hollow cylinder to each said cutter unit, and a link having a length one half of that of said parallel links for connecting a middle point of each lower link of said parallel links to a lower end of said inner hollow cylinder, thereby moving said cutter units radially toward and away from said center shaft by telescopically moving said outer and inner hollow cylinders relatively to each other by means of said fluid operated cylinder.

2. A rotary excavator as set forth in claim 1, wherein said cutter units are four, among which is one pair of diametrically opposed cutter units, each of which comprises a curved sidewall plate and a bottom plate in the form of a crescent secured to said sidewall plate, and the other of said cutter units is a pair of diametrically opposed cutter units, each of which comprises a curved sidewall plate, a bottom plate in the form of a crescent secured to said sidewall plate, and a triangular bottom plate hinged to said crescent bottom plate, and there is provided an elongated rectangular bottom plate.

3. A rotary excavator as set forth in claim 1, wherein said outer hollow cylinder has a square cross-section, said bucket is divided into four portions and four sets of said parallel links are provided.

4. A rotary excavator as set forth in claim 3, wherein each set of said parallel links comprises a pair of parallel links.

5. A rotary excavator as set forth in claim 4, wherein said pair of parallel links are spaced away from each other at a maximum distance.

6. A rotary excavator as set forth in claim 4, wherein at least one reinforcing plate is provided between said pair of parallel links.

7. A rotary excavator as set forth in claim 1, wherein a head end of said hydraulic cylinder is connected to an upper end of said outer hollow cylinder and an external end of a piston rod of said hydraulic cylinder is connected to the lower end of said inner hollow cylinder.

8. A rotary excavator as set forth in claim 1, wherein said cutting unit comprises bottom plate closing and opening means which comprises a closing and opening rod rotatable about its substantially vertical axis and having at its upper end a crank portion, a spring for resiliently holding said rod against rotation about its axis, a bottom plate forming at least part of a bottom of the cutting unit and pivotally connected to the cutting unit, and a ratch member connected to a lower end of said rod and having at least one inclined surface having a cam action which causes the ratch member to rotate about the axis of said rod against a force of said spring when said inclined surface abuts against an edge of an aperture formed in said bottom plate being pivotally raised, so as to bring the ratch member in alignment with said aperture of said bottom plate to cause the ratch member to pass therethrough.

* * * * *